US007287750B2

(12) United States Patent
Boguhn et al.

(10) Patent No.: US 7,287,750 B2
(45) Date of Patent: Oct. 30, 2007

(54) MACHINE FOR PROCESSING PRINTING MATERIAL SHEETS, IN PARTICULAR SHEET-FED PRINTING PRESS, AND METHOD OF OPERATING THE MACHINE

(75) Inventors: Hans Peter Boguhn, Heidelberg (DE); Jens Friedrichs, Neckargemünd (DE); Rudi Haupenthal, deceased, late of Epfenbach (DE); by Andrea Martha Haupenthal, legal representative, Epfenbach (DE); Karl-Heinz Helmstädter, Heidelberg (DE); Hans-Peter Hiltwein, Waghäusel (DE); Olaf Lorenz, Ludwigshafen (DE); Günter Stephan, Wiesloch (DE); Peter Thoma, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 487 days.

(21) Appl. No.: 10/848,662

(22) Filed: May 18, 2004

(65) Prior Publication Data

US 2004/0256796 A1 Dec. 23, 2004

(30) Foreign Application Priority Data

Jun. 18, 2003 (DE) ..... 103 27 421

(51) Int. Cl.
*B65H 5/02* (2006.01)

(52) U.S. Cl. ..... 271/275; 271/276; 271/314

(58) Field of Classification Search ..... 271/275, 271/276, 277, 314; 101/232, 279, 246, 409, 101/410, 420

See application file for complete search history.

(56) References Cited

U.S. PATENT DOCUMENTS

| | | | |
|---|---|---|---|
| 4,735,142 A | 4/1988 | Haupenthal | |
| 4,815,379 A | 3/1989 | Becker et al. | |
| 5,579,691 A | 12/1996 | Voge | |
| 6,082,260 A | 7/2000 | Friedrichs et al. | |
| 7,000,540 B2 * | 2/2006 | Conzelmann et al. | 101/230 |

FOREIGN PATENT DOCUMENTS

| | | |
|---|---|---|
| DE | 31 26 103 A1 | 6/1982 |
| DE | 35 35 621 C2 | 4/1987 |
| DE | 86 11 832.3 U1 | 12/1988 |
| DE | 195 46 311 A1 | 6/1996 |
| DE | 201 07 182 U1 | 8/2001 |
| EP | 0 230 032 B1 | 7/1987 |
| EP | 0 839 649 B1 | 5/1998 |
| EP | 0 875 376 A1 | 11/1998 |

* cited by examiner

*Primary Examiner*—David H Bollinger
(74) *Attorney, Agent, or Firm*—Laurence A. Greenberg; Werner H. Stemer; Ralph E. Locher

(57) ABSTRACT

A machine for processing printing material sheets, in particular a sheet-fed printing press, has a sheet transport drum for transporting the printing material sheets and at least one sheet supporting element. The sheet supporting element, which is formed with a sheet supporting surface, is compatible with the sheet transport drum, for supporting the printing material sheets in a first operating mode. When the machine is operated in the first operating mode the sheet supporting element is held attached to the sheet transport drum, and when the machine is operated in a second operating mode the sheet supporting element is stored in the machine detached from the sheet transport drum. A corresponding printing material processing machine is suitable for carrying out the novel method.

11 Claims, 7 Drawing Sheets

MACHINE FOR PROCESSING PRINTING MATERIAL SHEETS, IN PARTICULAR SHEET-FED PRINTING PRESS, AND METHOD OF OPERATING THE MACHINE

BACKGROUND OF THE INVENTION

Field of the Invention

The present invention relates to a method for operating a machine for processing printing material sheets. The machine comprises a sheet transport drum for transporting the printing material sheets and at least one sheet supporting element, which is compatible with the sheet transport drum, for supporting the printing material sheets in a first operating mode. The invention also pertains to a machine for processing printing material sheets, which machine comprises a sheet transport drum for transporting the printing material sheets and at least one sheet supporting element for supporting the printing material sheets. The sheet supporting element is configured to be compatible with the sheet transport drum in such a way that the sheet supporting element can be attached to the sheet transport drum and detached from the sheet transport drum as desired.

German utility model DE 86 11 832 U1 (Gebrauchsmuster) describes a sheet-fed printing press having a sheet transport drum, for which sheet supporting elements of various types are provided. One of the sheet supporting elements is installed on the sheet transport drum, the surface having been selected as a function of parameters of the print job to be processed which relate to the printing technology and are specific to the printing material. The sheet supporting elements which are not required for the print job are seemingly stored outside the sheet-fed printing press. The installed sheet supporting element can be exchanged for one of the stored sheet supporting elements if another subsequent print job makes the exchange necessary.

Commonly assigned U.S. Pat. No. 6,082,260 (and European patent EP 0 839 649 B1) describes a sheet-fed printing press whose sheet transport drum has two sheet supporting elements of different types. The surfaces are both permanently fastened to the sheet transport drum. For each print job, one of the sheet supporting elements is used in an active position in order to support the printing material sheets, and the other sheet supporting element is stored in a passive position, in which the unused sheet supporting element is, however, still fastened to the sheet transport drum. Which of the sheet supporting elements is in the active position and which in the passive position depends on the respective print job, for example on whether the print job requires paper sheet processing or board sheet processing.

In the case of the two above-mentioned examples from the prior art, the changeover of the sheet transport drum is associated with fitting work to be carried out manually. The work requires a comparatively large amount of fitting time.

SUMMARY OF THE INVENTION

It is accordingly an object of the invention to provide a sheet-processing machine and a method of operating a sheet-processing machine which overcomes the above-mentioned disadvantages of the heretofore-known devices and methods of this general type and which provides for favorable preconditions for shortening the fitting time, and for a machine which is suitable for carrying out the method.

With the foregoing and other objects in view there is provided, in accordance with the invention, a method of operating a machine for processing printing material sheets, the machine including a sheet transport drum for transporting the printing material sheets and at least one sheet supporting element compatible with the sheet transport drum, which comprises:

operating the machine in a first operating mode and thereby holding the sheet supporting element in attachment with the sheet transport drum and supporting the printing material sheets on the sheet supporting element;

operating the machine in a second operating mode and thereby storing the sheet supporting element in the machine in detachment from the sheet transport drum.

With the above and other objects in view there is also provided, in accordance with the invention, a machine for processing printing material sheets, comprising:

a sheet transport drum for transporting the printing material sheets;

at least one sheet supporting element having a sheet supporting surface for supporting the printing material sheets during processing, the sheet supporting element being configured compatibly with the sheet transport drum for selective attachment thereof to the sheet transport drum and selective detachment thereof from the sheet transport drum; and wherein the sheet supporting element is attached to the sheet transport drum in a first operating mode of the machine, and the sheet supporting element is stored in the machine in a second operating mode of the machine and detached from the sheet transport drum.

In other words, the method according to the invention for operating a machine for processing printing material sheets, which machine comprises a sheet transport drum for transporting the printing material sheets and at least one sheet supporting element, which is compatible with the sheet transport drum, for supporting the printing material sheets in a first operating mode, is characterized in that the machine is operated in the first operating mode and in the process the sheet supporting element is held in a manner attached to the sheet transport drum, and in that the machine is operated in a second operating mode and in the process the sheet supporting element is stored in the machine in a manner detached from the sheet transport drum.

The machine according to the invention, suitable for carrying out the method, for processing printing material sheets, which machine comprises a sheet transport drum for transporting the printing material sheets and at least one sheet supporting element for supporting the printing material sheets, the sheet supporting element being configured to be compatible with the sheet transport drum in such a way that the sheet supporting element can be attached to the sheet transport drum and detached from the sheet transport drum as desired, is characterized in that the sheet supporting element is attached to the sheet transport drum in a first operating mode of the machine, and is stored in the machine in a second operating mode of the latter and is detached from the sheet transport drum.

The invention provides favorable preconditions for semi-automating or fully automating the changeover of the sheet transport drum and, as a consequence, also for shortening the fitting time.

According to the invention, although the sheet supporting element is fastened in or to the machine, it is no longer fastened here to the sheet transport drum. In the second operating mode, the sheet supporting element is fastened to a part of the machine other than the sheet transport drum and is thus not rotated together with the sheet transport drum in the second operating mode. In the second operating mode, the sheet supporting element is therefore not stored separately from the machine, but rather in the machine, that is to say is fastened in or to the machine.

Other features and refinements that are considered as characteristic for the invention are set forth in the appended claims and explained briefly individually in the following text:

In accordance with an added feature of the invention, the machine comprises at least one further sheet supporting element of this type and thus comprises a plurality of sheet supporting elements. Said sheet supporting elements are configured to be compatible with the sheet transport drum in such a way that the sheet supporting elements are attached to the sheet transport drum in the first operating mode of the machine, and are stored in the machine in the second operating mode of the latter and are detached from the sheet transport drum. The sheet supporting elements are therefore held in the first operating mode in a manner attached to the sheet transport drum and are stored in the machine in the second operating mode in a manner detached from the sheet transport drum. The sheet supporting elements are attached to the sheet transport drum together in the first operating mode and are both detached from the latter at the same time in the second operating mode. The refinement described here is advantageous with regard to a sheet transport drum twice the size and likewise with regard to a sheet transport drum three times the size to which, in addition to the two abovementioned sheet supporting elements, an additional sheet supporting element is attached in the first operating mode and a total of three sheet supporting elements are therefore attached.

According to another refinement, the or each abovementioned sheet supporting element is stored in a storage device of the machine in the second operating mode. The machine therefore comprises at least one storage device for storing the or each abovementioned sheet supporting element in the second operating mode. The machine can comprise a first storage device for one sheet supporting element and a second storage device for the further sheet supporting element, that is to say in each case a dedicated storage device for each of the sheet supporting elements present, or instead can comprise a common, single storage device for both or all the sheet supporting elements of the sheet transport drum. The storage device or stores is/are advantageous for secure and protected, temporary storage of the sheet supporting element or surfaces.

According to a refinement which is advantageous with regard to rapid changeover, a conveying device of the machine is configured and activated as a semiautomatic or fully automatic system in such a way that the or each abovementioned sheet supporting element is conveyed into the storage device by mechanical means when the sheet transport drum is changed over semiautomatically or fully automatically for the purpose of changing from the first operating mode to the second operating mode.

According to a further refinement, there is provision from a process engineering point of view for the or each abovementioned sheet supporting element to be detached or released from the sheet transport drum by mechanical means during a rotational standstill of said sheet transport drum when the sheet transport drum is changed over semi-automatically or fully automatically for the purpose of changing from the first operating mode to the second operating mode. Within the scope of this refinement, there is provision from a machine engineering point of view for a control device of the machine to be connected to the sheet transport drum by control technology in such a way that the or each abovementioned sheet supporting element is detached from the sheet transport drum by mechanical means during a rotational standstill of said sheet transport drum maintained here by the control device when the sheet transport drum is changed over for the purpose of changing from the first operating mode to the second operating mode. The rotational standstill is a substantial difference which exists in conjunction with the present invention compared with devices which function semiautomatically or fully automatically for feeding and removing printing plates to or from a plate cylinder. This is because automatic plate changing devices of this type require a rotation of the plate cylinder both while the printing plate is being attached to the plate cylinder and while the printing plate is being detached from the plate cylinder.

According to a further refinement, a conveying device or the abovementioned conveying device of the machine is configured and activated as a semiautomatic or fully automatic system in such a way that the or each abovementioned sheet supporting device is conveyed onto the sheet transport drum by means of the conveying device by mechanical means when the sheet transport drum is changed over semiautomatically or fully automatically for the purpose of changing from the second operating mode to the first operating mode. As a result, manual handling of the sheet supporting element or surfaces is avoided, which handling is possible only in an awkward manner in many cases on account of the size of the sheet supporting element or surfaces.

One refinement is likewise advantageous with regard to relieving the operating personnel of fitting work which has to be performed manually, in which refinement the (only) or each abovementioned (that is to say, present for the sheet transport drum) sheet supporting element is attached to the sheet transport drum by mechanical means during a rotational standstill of said sheet transport drum when the sheet transport drum is changed over semiautomatically or fully automatically for the purpose of changing from the second operating mode to the first operating mode. For this purpose, a control device of the machine can be connected to the sheet transport drum by control technology in such a way that the or each abovementioned sheet supporting element is attached to the sheet transport drum by mechanical means during a rotational standstill of the sheet transport drum maintained here by the control device when the sheet transport drum is changed over for the purpose of changing from the second operating mode to the first operating mode.

If the machine is a sheet-fed printing press, the two abovementioned operating modes can differ from one another with regard to the type of printing material sheet to be printed in them in each case. There is preferably provision for a flexurally unstable sheet type, for example paper sheets, to be printed by the machine in the first operating mode and a flexurally stable sheet type, for example board sheets, to be printed by the machine in the second operating mode.

Although the invention is illustrated and described herein as embodied in a machine for processing printing material sheets, in particular sheet-fed printing press, and method of operating it, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
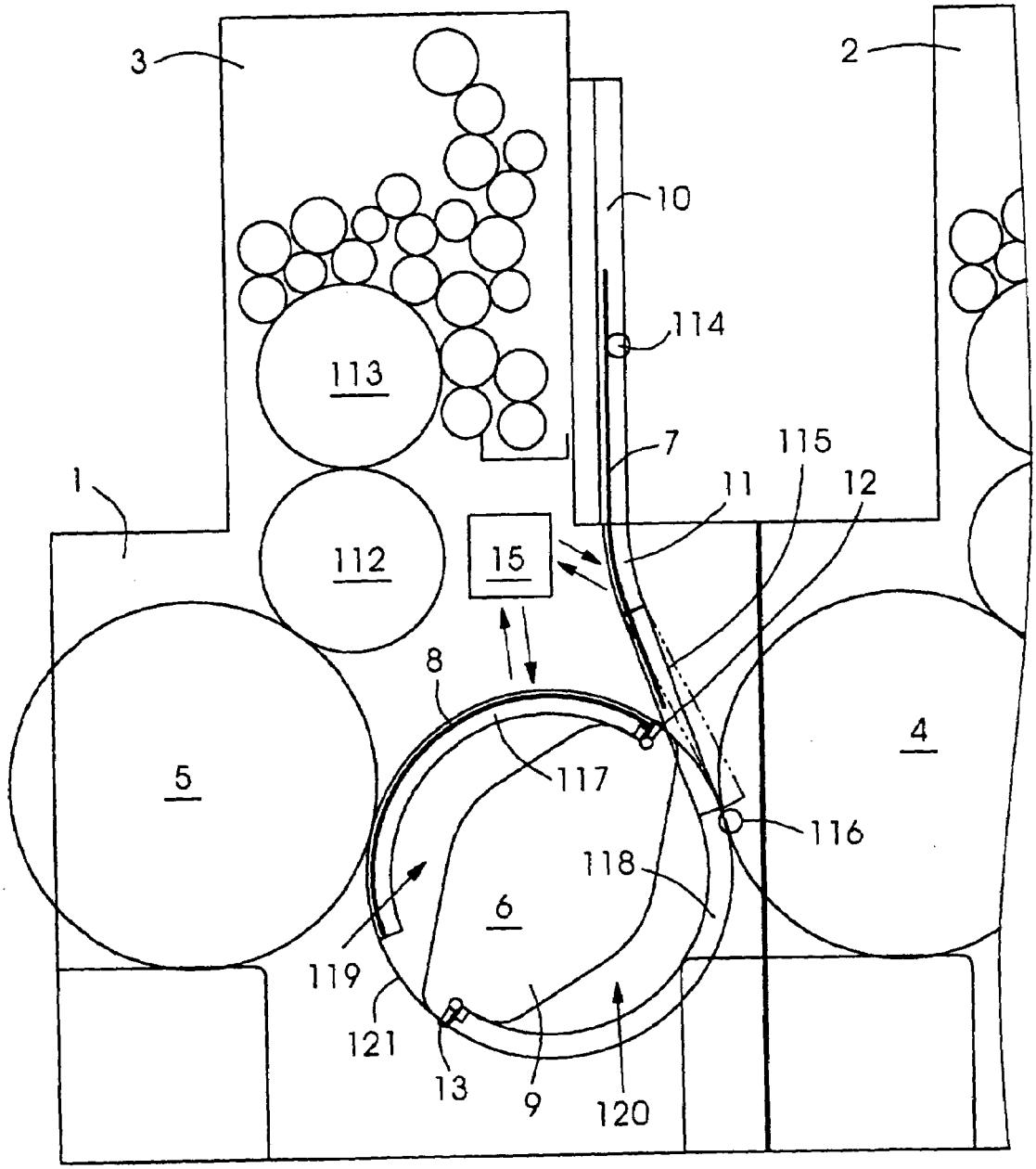
FIG. 1 is a side elevational view of a first exemplary embodiment of the invention having a substantially vertically oriented magazine for storing the sheet supporting elements.
Figure 2:
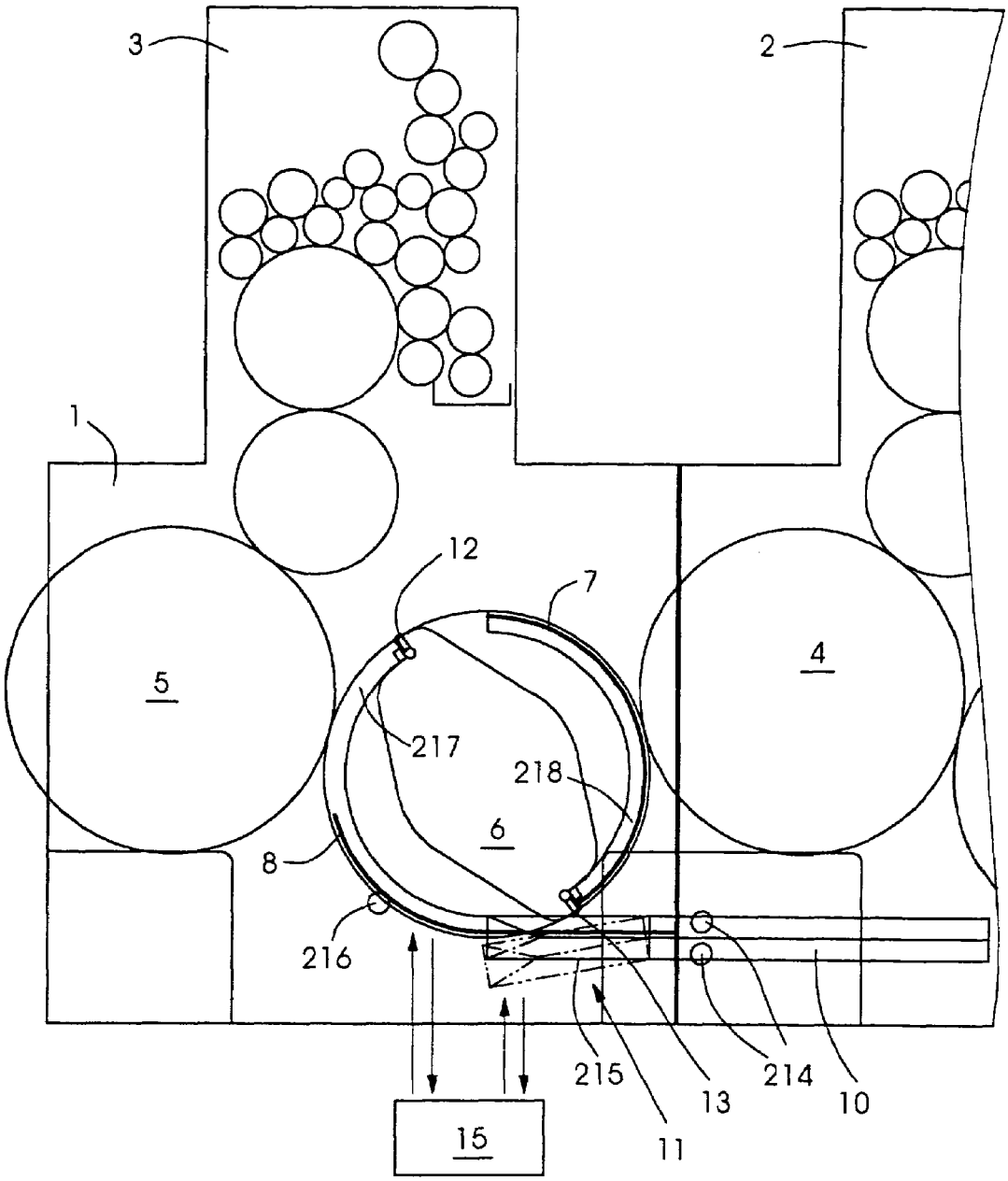
FIG. 2 is a side elevational view of a second exemplary embodiment having a horizontally oriented magazine or storage.

Referring now to the figures of the drawing in detail, it will first be noted that each of the exemplary embodiments illustrated therein relates to a sheet-fed rotary press 1 of in-line construction having printing units 2, 3 arranged one behind another for offset printing. The sheet-fed printing press 1 is a perfector which can be optionally switched between pure recto printing and recto and verso printing. A double sized sheet transport drum 6 which, in printing operation, accepts the printing material sheets directly from the upstream impression cylinder 4 and transfers them directly to the downstream impression cylinder 5 is situated between an impression cylinder 4 of the printing unit 2 arranged ahead of it (upstream) in the sheet transport direction and an impression cylinder 5 of the printing unit 3 arranged behind it (downstream). The impression cylinders 4, 5 and the sheet transport drum 6 each have a plurality of gripper systems 12, 13, specifically two, which serve to clamp the printing material sheets fixedly. The gripper systems are disposed distributed at identical angular spacings, which are 180° here, from one another along the circumference of the cylinder or drum.

The sheet transport drum 6 is a so-called vario drum, whose effective drum profile can be varied so as to correspond to the respective requirements. Additional information concerning vario drums may be found in the commonly assigned, copending application Ser. No. 10/744,737, which is herewith incorporated by reference. In order to give the drum profile a substantially circular outer contour, sheet supporting elements 7, 8 with sheet supporting surfaces can be fastened, if required, to a basic body 9 of the sheet transport drum 6. In order to give the drum profile a narrow outer contour, specifically an oval or rhombic outer contour, the sheet supporting elements 7, 8 can be removed from the basic body 9 if required. Without the sheet supporting elements 7, 8, that is to say when they are dismantled, the narrowly (ovally or rhombically) contoured basic body 9 becomes effective in a manner which determines the drum profile. In pure recto printing operation, the sheet transport drum 6 is used, with deployment of its sheet supporting elements 7, 8 which are installed in this case, both to transport unstable printing material sheets, for example paper sheets, and also to transport stable printing material sheets, for example board sheets, depending on which of the two sheet types has to be printed in a manner appropriate to the respective print job. In recto and verso printing operation, the sheet transport drum 6 is used, with deployment of the sheet supporting elements 7, 8, only for the unstable printing material sheets, and the sheet transport drum 6 is used for the stable printing material sheets without deployment of the sheet supporting elements 7, 8, that is to say with the sheet supporting elements 7, 8 dismantled and removed from the basic body 9.

The sheet supporting elements 7, 8 are so-called anti-smearing surfaces which, on account of their material and/or relief attributes, have the property of repelling the printing ink which is still fresh on printing material sheets that have not yet dried sufficiently. The sheet supporting elements 7, 8 can be coated, for example, with chrome or another ink-repelling material and/or be provided with a microroughness or macrostructure. The sheet supporting elements 7, 8 can also be fitted with a textile material, the fabric of which forms an ink-repelling relief and/or is impregnated with an ink-repelling impregnation.

The sheet-fed printing press 1 comprises a storage device 10 which is outside the sheet transport drum 6, arranged next to the latter and in which the sheet supporting elements 7, 8 are stored or put in a magazine during that operating mode of the sheet-fed printing press 1 in which the sheet supporting elements 7, 8 are not required for the transport of the printing material sheets and are therefore removed from the sheet transport drum 6. Moreover, the sheet-fed printing press 1 comprises a conveying device 11 for conveying the sheet supporting elements 7, 8. The sheet supporting elements 7, 8 are fed from the storage device 10 to the sheet transport drum 6 by means of said conveying device 11 when the sheet transport drum 6 is fitted with the sheet supporting elements 7, 8 in a semiautomatic or preferably fully automatic manner. The conveying device 11 also serves for automatically removing the sheet supporting elements 7, 8 from the sheet transport drum 6 after their use and conveying them back into the storage device 10 again.

An electronic control device 15 controls the sheet transport drum 6, the storage device 10 and the conveying device 11 during the automatic installation and dismantling of the sheet supporting elements 7, 8 in accordance with a program stored in the control device 15. The control device 15 is coupled by control technology to a motor which rotates the sheet transport drum 6 during printing operation, and holds the motor and therefore the sheet transport drum 6 at a standstill during that installation time period at the beginning of which the sheet supporting element 7 or 8 which is to be installed comes into contact with the sheet transport drum 6 and at the end of which the sheet supporting element has been installed correctly. Moreover, the control device 15 is coupled by control technology to drives of the storage device 10 and the conveying device 11.

In the following text, reference is made to the various exemplary embodiments in detail.

Referring now to the first exemplary embodiment of the invention illustrated in FIG. 1, the sheet supporting elements 7, 8 are thin and flexible plates, for example resilient metal sheets or flexurally resilient films or foils, of substantially rectangular form. The storage device 10 is a cassette and is arranged substantially above the sheet transport drum 6 and at the level of a printing form cylinder 112 of the printing unit 3 and its roll frame 113 which projects upward in the manner of a tower. The storage device 10 is divided into a plurality of separate compartments for the sheet supporting elements 7, 8, that is to say is of multi-chute configuration, and extends in a substantially vertical longitudinal direction which also corresponds to the feed direction of the sheet supporting elements 7, 8 within the storage device 10. The storage device 10 is equipped with a guide formed from rollers or rails for the sheet supporting elements 7, 8 and with at least one drive element 114, specifically a drive roller, which pushes the respective sheet supporting element 7 or 8 out of the storage device 10 and pulls it into the storage device 10 again after its use. The storage device 10 is adjoined by the conveying device 11 which comprises a guide 115, mounted in a side wall so as to be pivotable toward the sheet transport drum 6 and away from the latter, and a drive element 116, likewise configured as a drive roller.

At each of its two mutually opposite drum axle ends, the sheet transport drum 6 has two diametrically arranged guides 117, 118 for the sheet supporting elements 7, 8, that is to say a total of four guides. The guides 117, 118 of the sheet transport drum 6 each determine a guide track in the shape of a circular arc and lie laterally outside the largest possible sheet format width which can be processed in the sheet-fed printing press 1. In this way, the sheet trailing edge of every single printing material sheet gripped at the sheet leading edge by the impression cylinder 5 can protrude briefly through between one guide 117 and its counterpart lying at the opposite drum axle end, or between the other guide 118 and its counterpart, into a substantially sickle-shaped clearance 119 or 120 which gapes open between the basic body 9 and an imaginary gripper flight circle 121 of the gripper systems 12, 13 of the sheet transport drum 6 when the sheet supporting elements 7, 8 are removed. The guides 117, 118 are connected to the basic body 9 fixedly so as to rotate with it and therefore rotate together with the basic body 9 when the sheet transport drum 6 is rotating in printing operation. The guide tracks of the guides 117, 118 are concentric with respect to the gripper flight circle 121 and have a somewhat smaller radius of curvature than the gripper flight circle 121, with the result that the sheet supporting elements 7, 8 are approximately radially flush with the gripper flight circle 121 when the sheet supporting elements 7, 8 are seated in or on the guides 117, 118.

The guide 115 of the conveying device 11 extends, at least with its lower section, toward the upstream impression cylinder 4 and is inclined slightly, that is to say at a small angle, relative to the storage device 10. A free end of the guide 115 can be pivoted as desired into a first position and a second position, indicated by phantom lines in FIG. 1. In the first position, the guide 115 is displaced toward the sheet transport drum 6 and the free guide end is situated opposite one of the guides 117, 118 of the sheet transport drum 6 in such a way that, in a manner driven by the drive elements 114, 116, the sheet supporting element 7 or 8 can be pushed out of the guide 115 into the corresponding guide 117 or 118 of the sheet transport drum 6. In the second position, the free end of the guide 115 is displaced away from the sheet transport drum 6 and said free guide end is not situated opposite the appropriate guide of the sheet transport drum 6. During printing operation, the guide 115 assumes exactly said second position. In both positions, in the first position and in the second position, the free guide end is situated in the direct vicinity of a common, imaginary tangential point of the upstream impression cylinder 4 and the sheet transport drum 6. Said tangential point is also called what is known as the sheet transfer point, because the printing material sheet is transferred from the impression cylinder 4 to the sheet transport drum 6 in its region.

In the second exemplary embodiment shown in FIGS. 2 to 5, the sheet supporting elements 7, 8, the sheet transport drum 6 including its guides 217, 218, the conveying device 11 including its pivotable guide 215 and the drive elements 214, 216 have the same attributes as in the first exemplary embodiment shown in FIG. 1. In order to clarify this, designations 214 to 218 which are in each case higher by the amount 100 with respect to FIG. 1 are used for those parts that are structurally identical to the parts 114 to 118 in FIG. 1.

In contrast with the first exemplary embodiment, in the second exemplary embodiment the storage device 10 and the conveying device 11 connected to it are, however, placed below the impression cylinder 4 and the sheet transport drum 6 and oriented in such a way that the longitudinal direction of the storage device 10, which is also the feed direction of the sheet supporting elements 7, 8 in this storage device, is substantially horizontal. Using the detailed representation according to FIG. 3, it can be seen that the guides 217, 218 are equipped with guide rollers 219 which are arranged along their guide tracks and against which the respective sheet supporting element which is to be installed or dismantled automatically (in FIG. 3 this is the sheet supporting element 8 by way of example) is pressed by the drive element 216 which in the process rolls on the sheet supporting element 8 and drives the latter forward by friction. The drive element 216 has an elastomeric circumferential surface, using which it rolls on the sheet supporting element 8 while conveying the latter. In order that the drive element 216 does not collide with the rotating sheet transport drum 6 during printing operation, it is mounted such that it can be set away from the sheet transport drum 6 by means of a pivoting lever 220 before printing operation commences.

The storage device 10 is equipped with a first chute 221 for accommodating one sheet supporting element 7 and a separate, second chute 222 for accommodating the other sheet supporting element 8, the two chutes 221, 222 being arranged next to one another and being separated from one another by a separating wall or the like. The storage device 10 is thus subdivided into various compartments for the sheet supporting elements 7, 8. Accordingly, the drive element 214, which is likewise a drive roller provided with an elastic circumferential surface, is also arranged on the storage device 10 a number of times, namely at least one said drive element per chute 221, 222.

Figure 3:
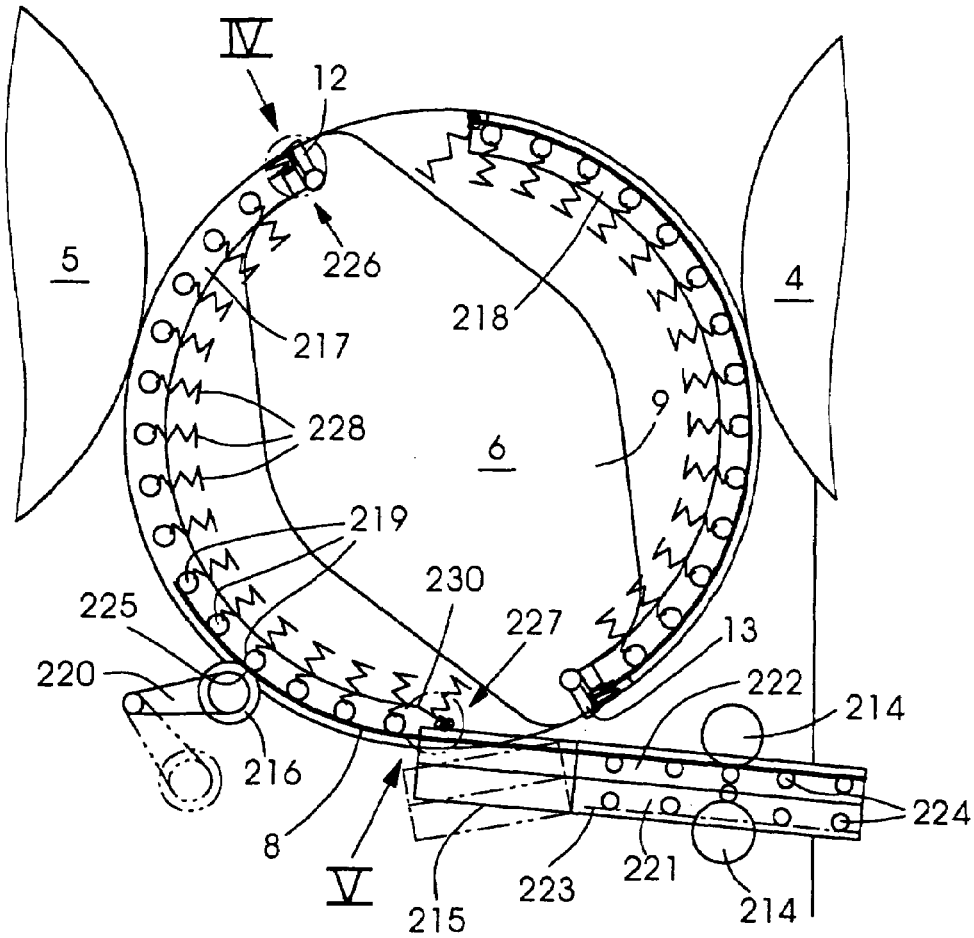
FIG. 3 is a more detailed view of a part thereof.

Each of the chutes 221, 222 has a dedicated, rectilinear guide track 223 which is indicated in FIG. 3 with a phantom line using the example of the first chute 221. The guide track 223 is determined by guide rollers 224 arranged in a row and could instead be determined by a guide rail replacing the guide rollers 224. The drive element 214 presses the respective sheet supporting element 7 or 8 against the guide rollers 224 and advances the sheet supporting element along the guide track 223 by rolling on said sheet supporting element. A point of clamping or contact 225 which is predetermined by the drive element 216 does not lie in exact alignment with the guide track 223 of the first chute and is also not aligned with the guide track of the second chute 222. As a consequence, the sheet supporting element 8 to be installed is bent over by the drive element 216 toward the sheet transport drum 6 during installation and forced to adapt itself to the course of the guide 217 or to bear tightly against the sheet transport drum 6.

The sheet supporting elements 7, 8 are securely fastened to the sheet transport drum 6 by each of the guides 217, 218 being assigned a pair of holding devices, each of the pairs of holding devices having a front holding device 226 for holding the leading (as seen in the direction of rotation of the sheet transport drum 6) supporting surface end of the sheet supporting element 7 or 8 and a rear holding device 227 for holding the trailing supporting surface end or the rear edge of the corresponding sheet supporting element.

In their state in which they are installed on the sheet transport drum 6 and in which the ends of the sheet supporting elements 7, 8 are fixed with the in each case two holding devices 226, 227, the sheet supporting elements 7, 8 are pressed outward over the guide rollers 219 by springs 228 (with which the guide rollers 219 are loaded substantially in the radial direction of the drum), and as a result held under flexural tension which ensures dimensional stability, in their longitudinal section which lies between the holding devices 226, 227. This sprung mounting of the sheet supporting elements 7, 8 reliably ensures their shell-like shape which is convex in the installed state and their elastic line in the installed state which is substantially in the shape of a circular arc.

Figure 4:
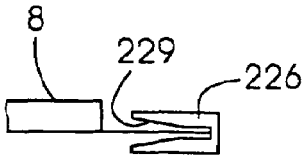
FIG. 4 is a detail view of the forward holding device.

FIG. 4 shows the front holding device 226 in detail, with the result that its cross-sectional shape in the form of a claw can be readily seen. The front holding device 226 is formed as a rail which is parallel relative to the axis of rotation of the sheet transport drum 6, and has a slot 229 whose inlet is chamfered for the purpose of centering the sheet supporting element 8 as it is inserted into the slot 229. The slot 229 is closed by a slot base on its slot side which points in the direction of rotation in printing operation (that is the clockwise direction in FIG. 3) of the sheet transport drum 6, and is open on its opposite slot side which faces the sheet supporting element 8 which is to be received. The front holding device 226 functions as a stop for the tapered front edge of the sheet supporting element 8 when the latter abuts the base of the slot 229 or its closed side, and also secures its position radial to the drum when the front edge is inserted into the front holding device 226.

Figure 5:
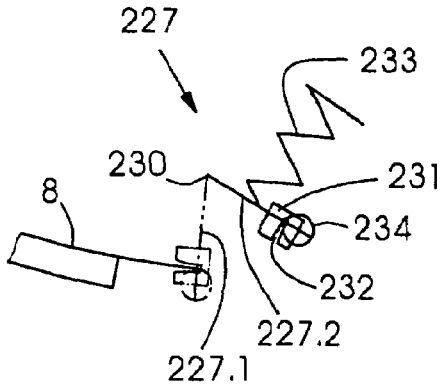
FIG. 5 is a detail of the rearward holding device.

FIG. 5 shows the rear holding device 227 in detail, with the result that it can be seen that the rear holding device 227 is configured as a latching flap and comprises a rail 231 which can be pivoted about a rotary joint 230 of the sheet transport drum 6 and has a slot 232 whose inlet is chamfered. The two rails of the holding devices 226, 227 are arranged in such a way that their slots substantially face one another. The two rails extend as crossmembers in each case substantially over the entire drum length in a longitudinal direction which is parallel relative to the axis of rotation of the sheet transport drum 6. The rail 231 of the rear holding device 227 is assigned a restoring spring 233 which, on account of its prestressing, attempts to displace the rear holding device 227 or its rail 231 substantially toward the front holding device 226 into an engaged or holding position 227.1 and in the process push the slot 232, which likewise has a tapered profile, over the rear edge of the sheet supporting element 8. Attached to the rear holding device 227 is a contact roller 234 which can be made contact with by the guide 215 (cf. FIG. 3) when the guide 215 is displaced toward the sheet transport drum 6 which is rotationally stationary here. The contact between the guide 215 and the rear holding device 227 has the effect that the latter is displaced back by the former to such an extent into the interior of the sheet transport drum 6 counter to the effect of the restoring spring 233 that the delivery or removal path of the sheet supporting element 8 is free and is no longer blocked by the rear holding device 227. Subsequently, the rear holding device 227 is situated in its waiting or passive position 227.2 withdrawn from the sheet supporting element 8, until the guide 215 is displaced away from the sheet transport drum 6 again after the sheet supporting element 8 has been installed on the latter, and consequently the restoring spring 233 displaces the rear holding device 227 toward the installed sheet supporting element 8 and engages it in a holding manner with the latter. The rear holding device 227 latches in automatically, as it were, after the guide 215 has been pivoted away again.

Figure 6:
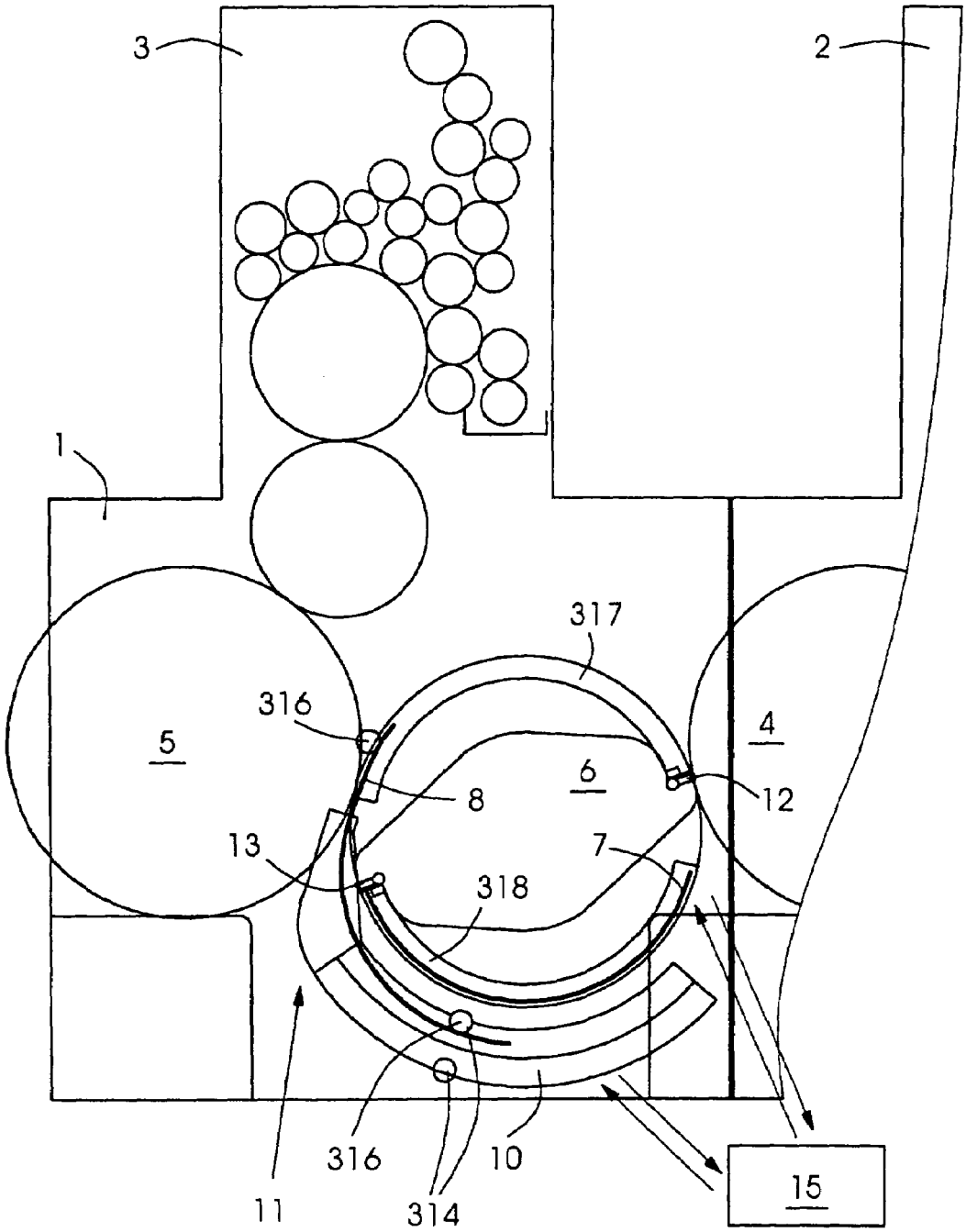
FIG. 6 is a side elevational view of a third exemplary embodiment of the invention in which the sheet supporting elements are flexurally elastic and the storage magazine is curved.
Figure 7:
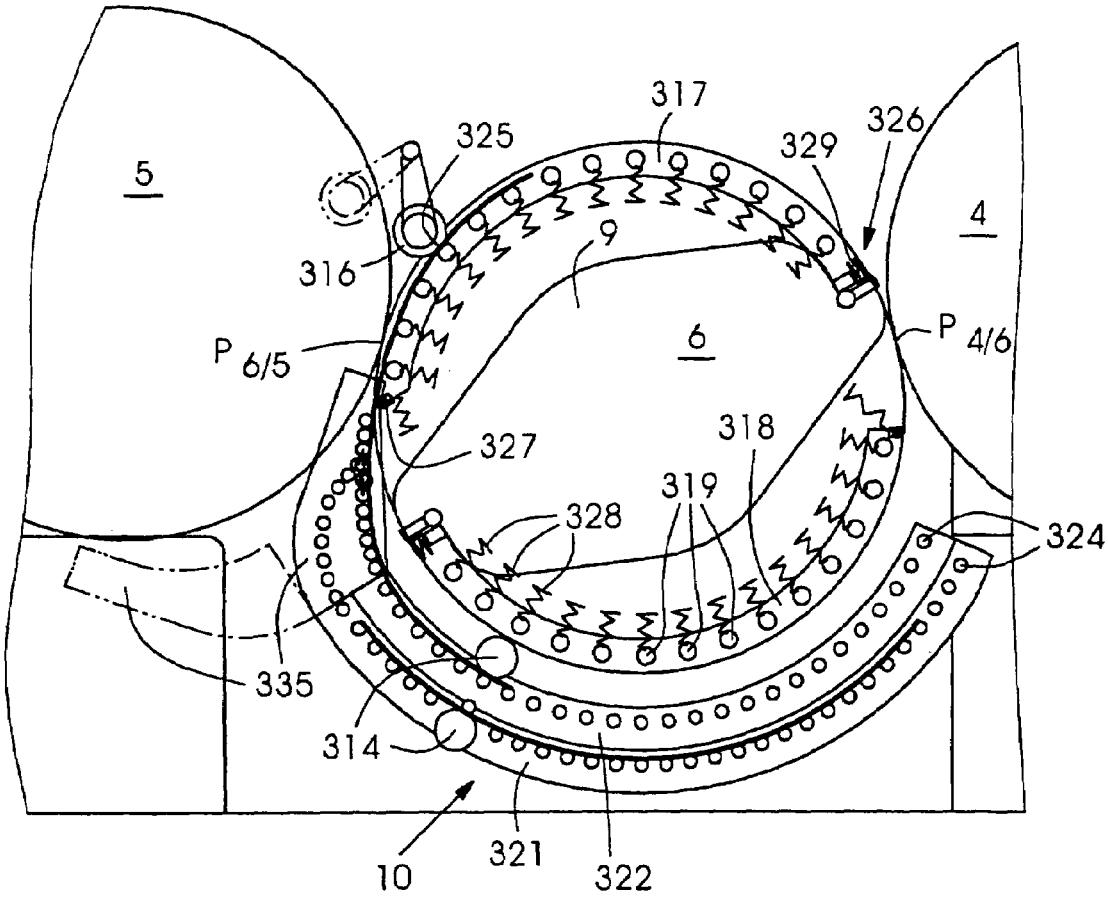
FIG. 7 is a more detailed view of a part thereof.
Figure 8:
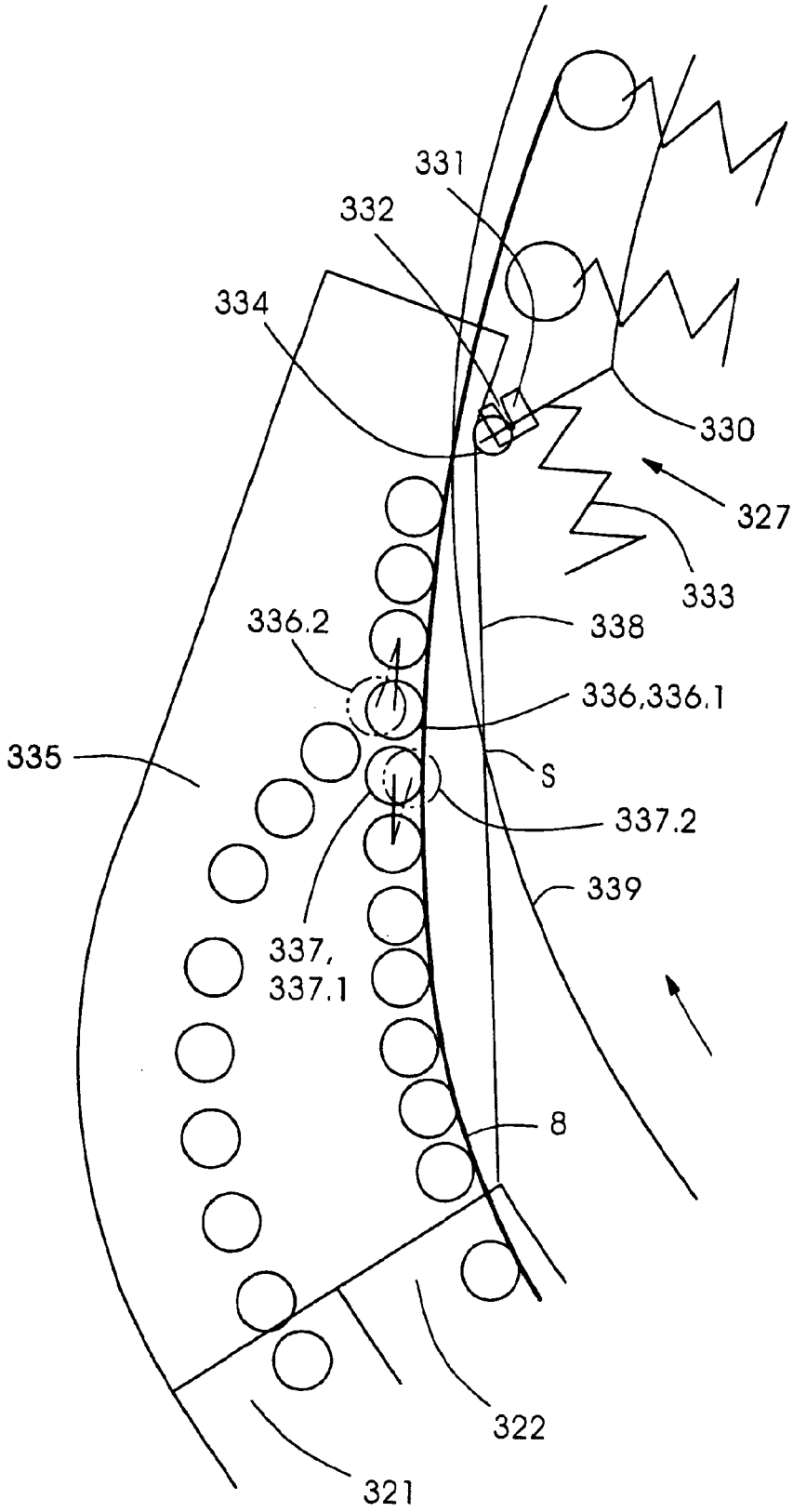
FIG. 8 is an enlarged detail of the diverter region of the device.

A third exemplary embodiment is shown in FIGS. 6 to 8. The parts described therein with the designations 314, 316, 317 to 319, 321, 322, 324 to 334 correspond in their construction to the parts 214, 216, 217 to 219, 221, 222, 224 to 234 of the second exemplary embodiment (cf. FIGS. 2 to 5) in the abovementioned order and therefore do not need to be explained again with regard to their attributes. In the following text, those features will be described by which the third exemplary embodiment differs from the second exemplary embodiment:

In the third exemplary embodiment, the storage device 10 is configured substantially in the shape of segments of an annulus and the guide tracks of its two chutes 321, 322 extend concentrically with respect to the sheet transport drum 6 or its gripper flight circle. The two guide tracks in the shape of a circular arc, which are determined by the guide rollers 324, extend over the length of the chutes 321, 322 concentrically with respect to one another. A diverter 335 which is mounted so as to be pivotable as required into an active position (FIG. 7: solid line) for the transport of sheet supporting elements and into a collision-free passive position (FIG. 7: phantom line) for printing operation is connected to the storage device 10, in which diverter 335 the two guide tracks are brought together or fork off from one another, depending on which feed direction of the sheet supporting elements 7, 8 the diverter is viewed from.

FIG. 8 shows the diverter 335 in detail, it becoming clear from said Figure. that a first switching roller 336 and a second switching roller 337 are the substantial (switching) elements of the diverter 335. The switching rollers 336, 337 are mounted so as to be pivotable as desired into a first switching position 336.1 or 337.1 and a second switching position 336.2 or 337.2. If the switching rollers 336, 337 are displaced into the first switching position 336.1 or 337.1, there exists a diverter position of the diverter 335 in which the diverter 335 guides the sheet supporting element 8 into or out of the second chute 322. In contrast, the second switching position 336.2 or 337.2 serves to produce another diverter position in which the other sheet supporting element 7 is guided into or out of the first chute 321 by the diverter 335.

As, in the third exemplary embodiment in contrast with the second exemplary embodiment, there exists no guide which is comparable with the movable guide 215 and a guide of this type is also not necessary at all, the locking and unlocking of the rear holding device 327 is brought about by its movement together with the sheet transport drum 6. During this movement or the rotation of the sheet transport drum 6, the rear holding device 327 or its contact roller 334 abuts a cam 338 which is arranged fixedly on the diverter 335 and therefore outside the sheet transport drum 6. The cam 338 extends substantially as a secant with respect to an imaginary flight circle 339 described by the rear holding device 327 during the rotation of the drum about the axis of rotation of the sheet transport drum 6, and therefore intersects the flight circle 339 at an imaginary intersection point S. At this intersection point S, the rear holding device 327 or its contact roller 334 strikes the cam 338 during the rotation (symbolized in FIG. 8 by an arrow) of the sheet transport drum 6, with the result that the rear holding device 327 is displaced away from the guide 317 and into the drum interior counter to the action of the restoring spring 333 after contact by the cam 338 during the slight further rotation of the sheet transport drum 6 which occurs until rotational standstill. Shortly afterward, the sheet transport drum 6 comes to a standstill in the rotary position necessary for the installation (or alternatively dismantling) of the respective sheet supporting element 7 or 8, during which standstill the sheet transport drum 6 is situated in exactly this rotary position shown in FIG. 7 and the rear holding device 327 is situated in its passive position which is displaced back and shown in FIG. 8. If, after automatic installation of the sheet supporting element, the sheet transport drum 6 again rotates further, the rear holding device 327 or its contact roller 334 again loses contact with the cam 338 and the rear holding device 327 is consequently displaced back automatically by its restoring spring 333 into the engaged or holding position required to secure the rear edge of the sheet supporting element.

A further special feature which the third exemplary embodiment has as compared with the second consists in that, in the third exemplary embodiment as seen in the direction of rotation of the sheet transport drum 6, the drive element 316 is arranged behind a common sheet transfer point $P_{6/5}$ of the sheet transport drum 6 and of the impression cylinder 5 and is arranged ahead of a sheet transfer point $P_{4/6}$ of the other impression cylinder 4 and of the sheet transport drum 6 (in the second exemplary embodiment, the drive element 216 is arranged behind the sheet transfer point $P_{4/6}$ and is arranged ahead of the sheet transfer point $P_{6/5}$). In other words: the corresponding drive element is assigned to the upper drum half in the third exemplary embodiment and to the lower drum half in the second exemplary embodiment.

The transfer of the sheet supporting element 7 or 8 from one of the drive elements 314, 316 to the other, which transfer takes place after said sheet supporting element has reached a specific feed position, is effected in principle in exactly the same way as in the other exemplary embodiments which have been explained in the previous text. That is to say, during the transfer the sheet supporting element is temporarily pushed forward simultaneously by the two drive elements 314, 316 in the respectively required delivery or removal direction, as is illustrated in FIG. 6 by way of example. The sheet supporting element to be conveyed is pushed forward only by one of the drive elements 314, 316 before said transfer phase and only by the other of the drive elements 314, 316 on its own after said transfer phase.

Figure 9:
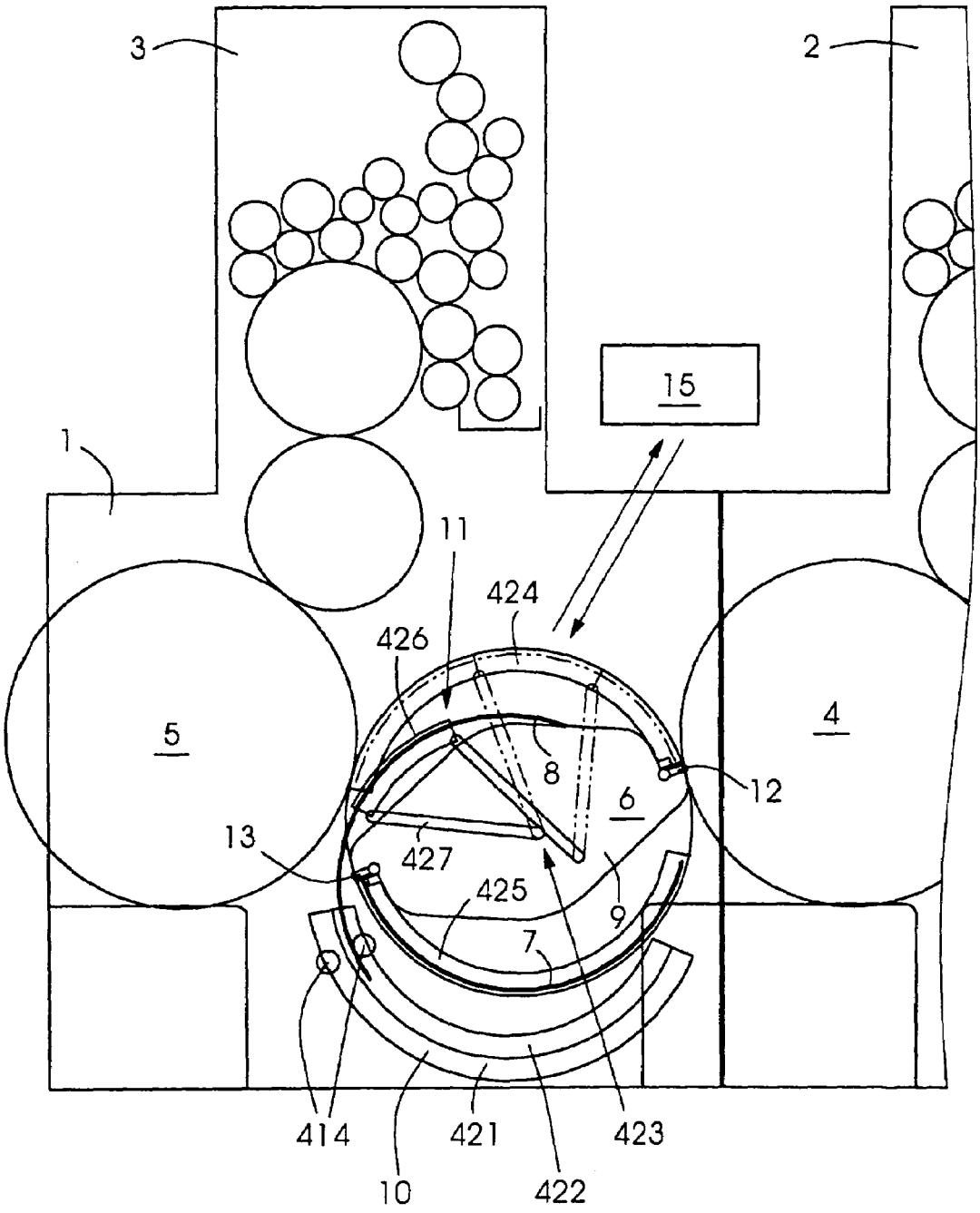
FIG. 9 is a side elevational view of a fourth exemplary embodiment in which the sheet supporting elements are flexurally rigid.

FIG. 9 shows a fourth exemplary embodiment, in which the storage device 10, including its drive elements (drive rollers) 414 assigned to the chutes 421, 422, is configured in exactly the same way as in the third exemplary embodiment (cf. FIGS. 6 to 8) and is arranged within the sheet-fed printing press 1 next to the sheet transport drum 6.

In contrast with all the exemplary embodiments which have been described above and in which the sheet supporting elements 7, 8 are flexible plates which are bent reversibly while they are being conveyed for the purpose of installation or dismantling, the sheet supporting elements 7, 8 in the fourth exemplary embodiment are rigid shells which cannot be bent during their conveyance. They retain their shape permanently.

For this reason, a lifting device 423 is provided which lifts the sheet supporting elements 7, 8 away from the storage device 10 and toward holding means 424, 425 during installation and lifts them back to the storage device 10 again during dismantling. The holding means 424, 425 are arranged on the sheet transport drum 6 instead of on the guides inside the drum (cf. FIGS. 1, 2, 6: positions 117, 118; 217, 218; 317, 318). If the lifting device 423 is fixedly disposed outside the sheet transport drum 6, for example on a machine frame, it is possible for a single one of the holding device 423 to fit both holding means 424, 425 one after another with the sheet supporting elements 7, 8. Otherwise, if the holding device is disposed inside the drum, that is to say on the sheet transport drum 6 and rotating with the latter during its rotation, it is advantageous to provide a plurality of lifting devices 423 and thus to assign a different, dedicated lifting device 423 to each of the holding means.

The or each lifting device 423 comprises a support 426 which has a hollow profile, is matched to the curvature of the holding means 424, 425 and of the sheet supporting elements 7, 8, and into which the sheet supporting element to be installed is pushed by the appropriate drive element 414 and from which said sheet supporting element is pulled by the drive element 414 again during its dismantling. The support 426 can be, for example, a tubular piece which is curved over its length. The support 426 is mounted by means of at least one pivoting lever 427, which can be a constituent part of a coupling mechanism, such that it can move to and fro between the storage device 10 and the respective holding means 424 or 425 along an imaginary curved path described here by the support 426, with the result that said support 426 is capable of inserting the sheet supporting element seated in it into the holding means 424 or 425 accurately or of inserting it into the storage device 10.

It should be pointed out here that a common feature of all four exemplary embodiments described herein is that the sheet transport drum 6 does not rotate during the installation of each sheet supporting element 7, 8 on the sheet transport drum 6 and also during dismantling. It will be understood, however, that the does not preclude the sheet transport drum 6 from being rotated by motor, in accordance with the program being executed in the control device 15, from a rotary position that is suitable for fitting or removing the first sheet supporting element 7 to or from the sheet transport drum 6 into a rotary position which is suitable for fitting or removing the second sheet supporting element 8 to or from the sheet transport drum 6, after installation (or, alternatively, dismantling) of the first sheet supporting element 7 has been effected in a first step and before installation (or, alternatively, dismantling) of the second sheet supporting element 8 has been effected in a second step. The change in rotary position effected between the two automatic assembly steps (or dismantling steps) merely serves in these cases to displace the guide or holding means arranged on the sheet transport drum 6 for the respective sheet supporting element into the correct relative position relative to the storage device 10.

In every exemplary embodiment, it is possible to provide the storage device 10 with an additional or auxiliary device serving to maintain the sheet supporting elements 7, 8, such as a cleaning device for washing the sheet supporting elements 7, 8 stored in the storage device 10.

This application claims the priority, under 35 U.S.C. § 119, of German patent application No. 103 27 421.9, filed Jun. 18, 2003; the disclosure of the prior application is herewith incorporated by reference in its entirety.

We claim:

1. A method of operating a machine for processing printing material sheets, the machine including a sheet transport drum for transporting the printing material sheets and at least one sheet supporting element compatible with the sheet transport drum, which comprises:

operating the machine in a first operating mode and thereby holding the sheet supporting element in attachment with the sheet transport drum and supporting the printing material sheets on the sheet supporting element;

operating the machine in a second operating mode and thereby storing the sheet supporting element in the machine in detachment from the sheet transport drum.

2. The method according to claim 1, wherein the sheet supporting element is one of a plurality of sheet supporting elements adapted to the sheet transport drum, and the method comprises holding each of the sheet supporting elements in attachment with the sheet transport drum in the first operating mode and storing each of the sheet supporting elements in the machine and detached from the sheet transport drum in the second operating mode.

3. The method according to claim 1, which comprises storing the sheet supporting element in a storage device of the machine in the second operating mode.

4. The method according to claim 3, which comprises conveying the sheet supporting element into the storage device with a mechanical device when the sheet transport drum is changed over from operating in the first operating mode to operating in the second operating mode.

5. The method according to claim 4, which comprises changing the sheet transport surface with a semiautomatic or in a fully automatic change-over operation.

6. The method according to claim 4, which comprises detaching the sheet supporting element from the sheet transport drum with a mechanical device during a rotational standstill of the sheet transport drum for changing over from the first operating mode to the second operating mode.

7. The method according to claim 1, which comprises conveying the sheet supporting element onto the sheet transport drum with a mechanical device during a change-over from the second operating mode to the first operating mode.

8. The method according to claim 7, which comprises conveying the sheet supporting element to the sheet transport drum semiautomatically or fully automatically.

9. The method according to claim 1, which comprises attaching the sheet supporting element to the sheet transport drum with a mechanical device during a rotational standstill of the sheet transport drum for changing over the sheet transport drum from the second operating mode to the first operating mode.

10. The method according to claim 9, which comprises attaching the sheet supporting element semiautomatically or fully automatically.

11. The method according to claim 1, which comprises printing a flexurally unstable sheet type of the printing material sheets in the first operating mode, and printing a flexurally stable sheet type of the printing material sheets in the second operating mode.

* * * * *